United States Patent [19]

Maher

[11] Patent Number: 4,986,375

[45] Date of Patent: Jan. 22, 1991

[54] DEVICE FOR FACILITATING DRILL BIT RETRIEVAL

[76] Inventor: Thomas P. Maher, R.D. #1, Box, 61, U.S. Rte. 22, New Alexandria, Pa. 15670

[21] Appl. No.: 445,286

[22] Filed: Dec. 4, 1989

[51] Int. Cl.[5] ..... E21B 17/22; E21B 12/00

[52] U.S. Cl. ..... 175/323; 175/325; 175/394; 175/401

[58] Field of Search ..... 175/401, 394, 323, 325

[56] References Cited

U.S. PATENT DOCUMENTS

| | | | |
|---|---|---|---|
| 2,101,566 | 12/1937 | Vanderpool | 175/323 |
| 2,572,839 | 10/1951 | McClinton | 175/394 |
| 2,579,720 | 12/1951 | Atkinson | 175/323 |
| 2,650,798 | 9/1953 | Stohn | 175/394 X |
| 2,717,764 | 9/1955 | Cannon | 175/394 X |
| 2,727,730 | 12/1955 | Crake | 175/394 |
| 3,226,855 | 1/1966 | Smith | 175/394 X |
| 4,262,762 | 4/1981 | Potratz | 175/401 |
| 4,330,043 | 5/1982 | Sheffield et al. | 175/325 X |
| 4,385,669 | 5/1983 | Knutsen | 175/323 |
| 4,444,278 | 4/1984 | Roechetti | 175/394 X |

FOREIGN PATENT DOCUMENTS

| | | | |
|---|---|---|---|
| 1055923 | 6/1979 | Canada | 175/394 |

*Primary Examiner*—Hoang C. Dang

*Attorney, Agent, or Firm*—Clifford A. Poff

[57] ABSTRACT

A device for facilitating the retrieval of a drill bit from a crooked hole, a soft rock or a broken rock formation is disclosed. The device is secured to a drill string at one end and to a drill bit an an opposite end. The device includes a cylindrical member having a helical member of gradually increasing radial thickness secured about its periphery. The helical member has a plurality of hardened cutter members secured to and projecting from its periphery. The radial thickness of the helical member is greatest at that section of the device closest to the drill bit and least at that section of the device closest to the drill string. The device clears obstructions in the bore hole above the drill bit to ease the removal of the bit from the hole, while at the same time, the device avoids enlarging the bore hole on either the advancing or retrieving trip of the drill string. The device further serves to maintain alignment of the drill string during advancement into and retrieval from the bore hole.

3 Claims, 1 Drawing Sheet

DEVICE FOR FACILITATING DRILL BIT RETRIEVAL

BACKGROUND OF THE INVENTION

1. Field of the Invention

The present invention relates to earth drilling equipment, in general, and, in particular, to a device for facilitating retrieval of a drill bit from crooked holes, soft rock or broken rock formations.

2. Description of the Prior Art

In the past, when drilling through somewhat crooked holes, soft rock or broken rock formations, there has been a tendency for a drill bit to become stuck or jammed upon attempts to extract the bit from the hole or formation. Centralizing devices for spacing the bit from the wall of the hole have been used as a means to solve this problem. However, such centralizers , which are attached above or "behind" the drill bits in typical drill strings, are at least as great in radial dimension as the bits themselves. Hence, such devices may in fact be successfully used to space a drill bit from a wall of a bore hole during and after drilling. However, by virtue of their size, such centralizers frictionally contact the walls of the bore hole and such frictional contact sometimes significantly increases the amount of energy and power required to remove the bit, the centralizer and the drill string from the hole.

Another conventional device which is mounted above or "behind" a drill bit in a drill string is a reamer. A reamer, being of greater axial dimension than the drill bit, is designed to enlarge the hole after the bit has bored the hole. As with centralizers, reamers may also be used to space a drill bit from a wall of a bore hole during and after drilling. But again, due to their radial size they also frictionally engage the wall of the bore hole and increased energy is required to remove such a reamer-equipped drill string from the hole. Still further, there are times when it is undesirable or even prohibited to enlarge the hole, e.g., for purposes of space conservation and/or other related considerations, to a diameter greater than that which was originally bored by the drill bit.

An advantage exists, therefore, for a device which has little frictional contact with a bore hole wall and can thus facilitate the removal of a drill bit from a crooked hole, a soft rock or a broken rock formation without enlarging the bore hole on the advancing or the retrieving trip of the drill string. A further advantage exists for a device which can preserve alignment of a drill bit during advancement or retrieval thereof through a crooked hole or a formation change while maintaining a minimum of contact between the device and the wall of the bore hole.

It is therefore an object of the invention to provide a device which facilitates retrieval of a drill bit from crooked holes, soft rock or broken rock formations.

It is a further object of the invention to provide a device for facilitating retrieval of a drill bit from a hole by virtually eliminating frictional contact between the device and the wall of the bore hole.

It is a further object of the invention to provide a device for facilitating retrieval of a drill bit from a hole while at the same time avoiding enlargement of the bore hole on either the advancing or retrieving trip of the drill string.

It is a still further object of the invention to provide a device for preserving alignment of a drill bit during advancement or retrieval thereof through a crooked hole or a formation change while maintaining a minimum of contact between the device and the wall of the bore hole.

Still other objects and advantages will become apparent when one considers the attached drawings and the description of the invention presented hereinbelow.

SUMMARY OF THE INVENTION

For the purpose of facilitating the retrieval of a drill bit from a crooked hole, a soft rock or a broken rock formation, there is disclosed a device, which is provided in a drill string immediately above or "behind" a drill bit, formed as a cylindrical member having a helical or spiral flight member secured therearound. The helical member increases in radial thickness, as measured from the outer circumferential wall of cylindrical member, from an end of the cylindrical member which is attached to the drill string to an end of the cylindrical member which receives the drill bit. The helical member is formed as a "left-hand" helix and has a plurality of cutter members or hardened inserts secured on the outer periphery thereof. The cutter members are cutting inserts preferably formed of high speed steel, carbide steel, or the like. The inserts may also be provided with polycrystalline diamond (PCD) facing if desired.

The radial extent of the outermost tip of the lowermost cutter member, as measured from the center of the cylindrical member, is just slightly less than the outermost cutting radius of the drill bit. By such a construction, the cutter members, even the lowermost cutter member, only occasionally contact the wall of the bore hole during advancement and retrieval of the drill string. Such occasional contact being effected by the normal "wobbling" of the drill string associated with rotation thereof. With such a construction, the cutter members will not enlarge or ream the diameter of the bore hole, during either advancement or retrieval of the drill bit, beyond that diameter initially bored by the bit. However, such cutter members serve to effectively cut and remove any rock obstructions which may exist in the bore above the bit which must be eliminated before the bit can be removed. Still further, the tips of the cutter members serve to advantageously "kick" the drill string to maintain proper alignment thereof during advancement of the string through potential string-deviating obstacles such as a slight bends or other physical changes in the formation being drilled.

DESCRIPTION OF THE PREFERRED EMBODIMENT

Figure 1:
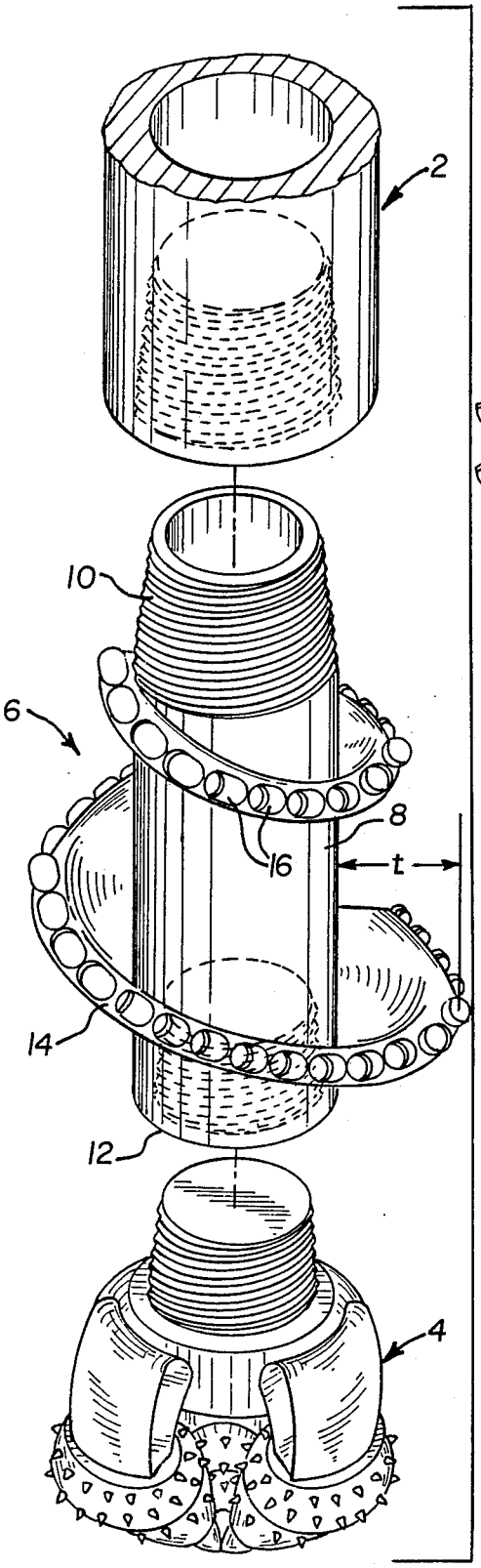
FIG. 1 is a elevation view illustrating the proper positioning of the drill bit retrieval device of the present invention between a conventional drill string and drill bit.

In FIG. 1 there is shown a lowermost member 2 of a typical drill string. Also depicted is a drill bit 4 which can be of any suitable type, but for purposes of illustration is shown as a rolling cone drill bit. In past drilling operations, the drill bit 4 was attached directly to the drill string 2 and such an arrangement was suitable for drilling a variety of rock formations. However, the use of such an arrangement in a crooked hole, a soft rock formation or a broken rock formation often led to the bit becoming jammed when the forward or advancing trip of the bit was halted and retrieval of the bit was attempted. Such jamming of the bit was caused by a variety of factors. For example, when forward drilling was ceased in a crooked hole and retrieval of the bit was attempted, the bit would oftentimes become jammed against a shoulder formed by a "dog leg" portion of the hole. And when drilling in soft or broken rock formations, rock pieces in the walls of the bore would sometime crumble and slide radially inwardly toward the center of the bore and, occasionally, large portions of the walls of the bore would collapse after the bit had passed thereby. In either of the latter two cases, retrieval of the bit was precluded by the presence of the rock overlying the bit which blocked the passage thereof back through the previously bored hole. It is for such situations that the device of the present invention has particular advantageous use.

As can be seen in FIG. 1, there is provided an apparatus, designated as numeral 6, for facilitating the retrieval of a drill bit from a crooked hole, a soft rock formation or a broken rock formation. The device 6 is run in with the drill string and bit 4 during the entire drilling operation, i.e., during both the advancing and the retrieving trips of the drill string and bit 4.

Figure 2:
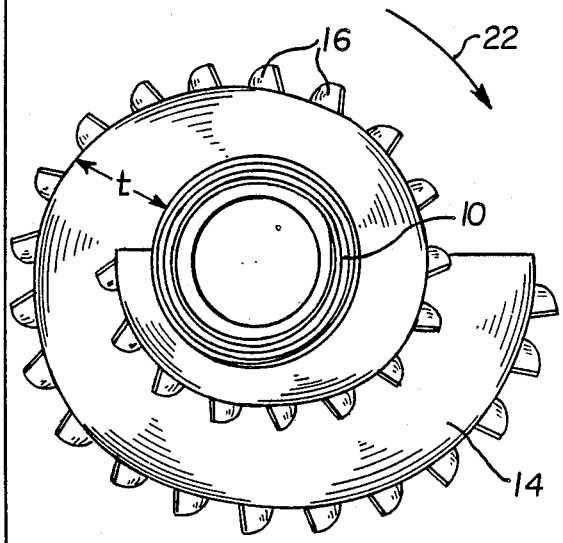
FIG. 2 is a plan view of the drill bit retrieval device and further indicating the direction of rotation of the drill string.

The device 6 includes a cylindrical member 8 having a first externally threaded male end 10 for attachment to a matingly threaded end of a lowermost member 2 of a typical drill string. The cylindrical member 8 further has a second internally threaded female end 12 for receiving a matingly threaded end of a drill bit such as roller cone bit 4. The threads of ends 10 and 12 are formed in the same direction and are typically right-hand taper A.P.I. threads so that the drill bit retrieval facilitating device 6 and the drill bit 4 will not become detached from the drill string during normal clockwise rotation thereof. The clockwise rotation of the drill string is indicated by arrow 22 in FIG. 2.

Figure 3:
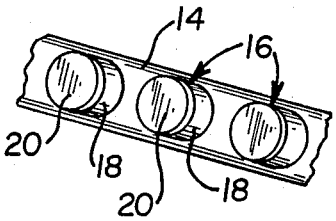
FIG. 3 is an enlarged view of typical cutter members which may be used with the drill bit retrieval device of the present invention.

Welded to the periphery of the outer cylindrical wall of cylindrical member 8 is a steel helical or spiral member 14. The radial thickness "t" of helical member 14 increases from the upper end of cylindrical member 8 nearest the drill string to the lower end of the cylindrical member nearest the drill bit 4. The helical member 14 traverses a left-handed spiral about the cylindrical member 8. By providing the direction of spiralling of the helical member 14 in a direction opposite to that of the direction of threading of the threaded ends 10 and 12, the helical member serves to : (1) prevent the various elements of the device 6 from detaching from another during rotation of the drill string, and (2) lift the device 6 from the bore hole during retrieval, as will be described in more detail hereinbelow. It should be understood, however, that the threads on ends 10 and 12 may be left-handed. If so, the direction of rotation of the drill string will be reversed, and the direction of spiralling of the helical member 14 will be right-handed. A plurality of spaced cutting members 16 are secured along the periphery of the helical member 14. The cutting members 16 are attached to the helical member 14 preferably by drilling a plurality of horizontal holes radially inwardly through the periphery of the helical member 14 at spaced locations therealong, inserting the cutting members 16 into the drilled holes, and silver-soldering the cutting members 16 into the holes. The cutting members can be formed of any of a number of high strength cutting materials including suitable carbide steel or high speed steel, for example, which have high hardness and wear resistance characteristics. Also suitable for use as the cutting members 16 are hardened steel inserts having polycrystalline diamond or "PCD" facing provided thereon. FIG. 3 shows an enlarged portion of FIG. 1 illustrating a type of insert which may be suitably used as a cutting member 16. As depicted in FIG. 3, the cutting member 16 is formed as a base insert 18 of hardened steel having a flat PCD facing 20 provided thereon. The PCD facing 20 is shown as being substantially vertical; however, the insert 18 may be so placed and secured in the helical member 14 that the facing 20 may be somewhat angled relative to the vertical. As can be appreciated, the flat surface of the facing 20 contacts the material to be cut when the drill string is rotated in the direction of arrow 22. The sizes, shapes and substance of the cutting members 16 can be widely varied depending on the specific requirements and characteristics of the formation being drilled. Also, the cutting faces of the inserts 16 need not be flat but may be curved, if desired.

The radially outermost tip of the radially outermost, i.e. the lowest, cutting member 16 is disposed radially inwardly of the outermost cutting radius of the drill bit 4. The purpose of maintaining the path traversed by the radially outermost cutting member within the outermost cutting radius of the drill bit is so that the device 6 does not ream the hole—either on the advancing or retrieving trip of the bit—to a diameter greater than that which was originally bored by the drill bit 4. Obviously then, a device constructed in accordance with the present invention is advantageous for easing retrieval of a drill bit without unnecessarily or detrimentally reaming the bored hole.

Still other advantages are provided by the unique construction of the drill bit retrieval facilitation device 6 of the present invention. It should be understood, for obvious reasons, that the same direction of rotation is maintained during advancement and retrieval of the drill string. If it were reversed, the various elements of the drill string could become detached from one another, especially if the drill bit had become stuck. Therefore, the lower, radially wider portion of the helical member 14 acts to use bored material cut from the formation during clockwise drilling as wedge means for lifting the drill bit when the same clockwise rotation is used for retrieval of the drill string. Also, the relatively narrow portion of the upper region of the helical number 14 is more easily guided into constricted or even caved-in areas of the bore hole above a stuck drill bit. Thus, such a construction permits the drill bit retrieval device 6 to free the drill bit 4 from clogged bore passages, and further clears the bore hole passage above the bit as the bit is moved upwardly through the bore hole upon retrieval.

Of no less importance, the particular construction of the tapering helical member 14 causes the drill bit 4 to "kick" to center to maintain alignment of the bit during advancement, and particularly during retrieval, through a crooked hole or a formation change while maintaining a minimum of contact between the device 6 and the bore hole. In other words, the normal wobbling of the drill string associated with normal rotation thereof causes only a minimal portion of the helical member 14 to be used to align or "kick" the bit to center. By maintaining a minimum amount of contact between the device 6 and the bore wall—even during wobbling of the string—the helical member 14 and the cutting members 16 secured thereto effectively center the bit without detrimentally gouging or reaming the bore wall.

While the present invention has been described in accordance with the preferred embodiments of the various figures, it is to be understood that other similar embodiment may be used or modifications and additions may be made to the described embodiment for performing the same functions of the present invention without deviating therefrom. Therefore, the present invention should not be limited to any single embodiment but rather construed in breadth and scope in accordance with the recitation of the appended claims.

I claim:

1. Apparatus for facilitating retrieval of a drill bit from a formation, said apparatus comprising:

a cylindrical member having a first threaded end adapted for attachment to a drill string and a second threaded end adapted for attachment to a drill bit, both of said ends being threaded in a common direction;

helical means secured to and radially outwardly projecting from the periphery of said cylindrical member, said helical means traversing a helical path about said cylindrical member in a direction opposite to said common direction; and a plurality of cutting members attached to and extending radially and outwardly from the periphery of said helical means, each cutting member having a cutting surface facing partially upwardly in the direction of the helical means, said cutting members serving to cut the formation during a retrieving trip of the drill string to facilitate retrieval of the drill bit from the formation.

2. The apparatus of claim 1 wherein said helical means increases in radial dimension from said first end to said second end.

3. The apparatus of claim 2 wherein the radially outermost tip of the radially outermost one of said cutting members is disposed radially inwardly of the outermost cutting radius of a drill bit with which said apparatus is adapted for use.

* * * * *